US008701540B2

(12) United States Patent
Hunn

(10) Patent No.: US 8,701,540 B2
(45) Date of Patent: Apr. 22, 2014

(54) ARMOR AND METHOD OF MAKING SAME

(75) Inventor: David L. Hunn, Kennedale, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 307 days.

(21) Appl. No.: 12/104,866

(22) Filed: Apr. 17, 2008

(65) Prior Publication Data

US 2012/0234163 A1 Sep. 20, 2012

Related U.S. Application Data

(63) Continuation-in-part of application No. 11/365,235, filed on Mar. 1, 2006, now abandoned, which is a continuation-in-part of application No. 11/347,526, filed on Feb. 3, 2006, now Pat. No. 7,546,796.

(51) Int. Cl.
*F41H 5/04* (2006.01)

(52) U.S. Cl.
USPC ..... 89/36.02; 89/906; 89/910; 89/917; 89/930

(58) Field of Classification Search
USPC ..... 89/36.01–36.17
See application file for complete search history.

(56) References Cited

U.S. PATENT DOCUMENTS

| | | | | | |
|---|---|---|---|---|---|
| 3,771,418 | A * | 11/1973 | Gulbierz et al. | ..... | 89/36.02 |
| 4,061,815 | A * | 12/1977 | Poole, Jr. | ..... | 428/215 |
| 5,361,678 | A * | 11/1994 | Roopchand et al. | ..... | 89/36.02 |
| 5,763,813 | A * | 6/1998 | Cohen et al. | ..... | 89/36.02 |
| 6,112,635 | A * | 9/2000 | Cohen | ..... | 89/36.02 |
| 6,289,781 | B1 * | 9/2001 | Cohen | ..... | 89/36.02 |
| 6,532,857 | B1 * | 3/2003 | Shih et al. | ..... | 89/36.02 |
| 6,575,075 | B2 * | 6/2003 | Cohen | ..... | 89/36.02 |
| 6,826,996 | B2 * | 12/2004 | Strait | ..... | 89/36.02 |
| 6,895,851 | B1 * | 5/2005 | Adams et al. | ..... | 89/36.02 |
| 6,920,817 | B2 * | 7/2005 | Ravid et al. | ..... | 89/36.11 |
| 6,955,112 | B1 * | 10/2005 | Adams et al. | ..... | 89/36.02 |
| 2005/0072294 | A1 * | 4/2005 | Cohen | ..... | 89/36.02 |
| 2009/0145289 | A1 * | 6/2009 | Cohen | ..... | 89/36.02 |
| 2010/0071537 | A1 * | 3/2010 | Weber et al. | ..... | 89/36.02 |
| 2010/0101402 | A1 * | 4/2010 | Ma | ..... | 89/36.02 |

* cited by examiner

*Primary Examiner* — Bret Hayes
(74) *Attorney, Agent, or Firm* — Beusse Wolter Sanks Mora & Maire, P.A.

(57) ABSTRACT

An armor includes a metallic matrix; a plurality of ceramic rods disposed in the metallic matrix, the plurality of ceramic rods and the metallic matrix forming a core; and a spall liner disposed adjacent a rear face of the core. The metallic matrix places a compressive stress on the plurality of ceramic rods. A method for making an armor includes the steps of providing a plurality of ceramic rods in a desired configuration and embedding the plurality of ceramic rods in a metallic matrix to form a core, such that the metallic matrix provides a compressive stress to the plurality of ceramic rods. The method further includes providing a spall liner and disposing the spall liner adjacent a rear surface of the core to form an armor.

20 Claims, 8 Drawing Sheets

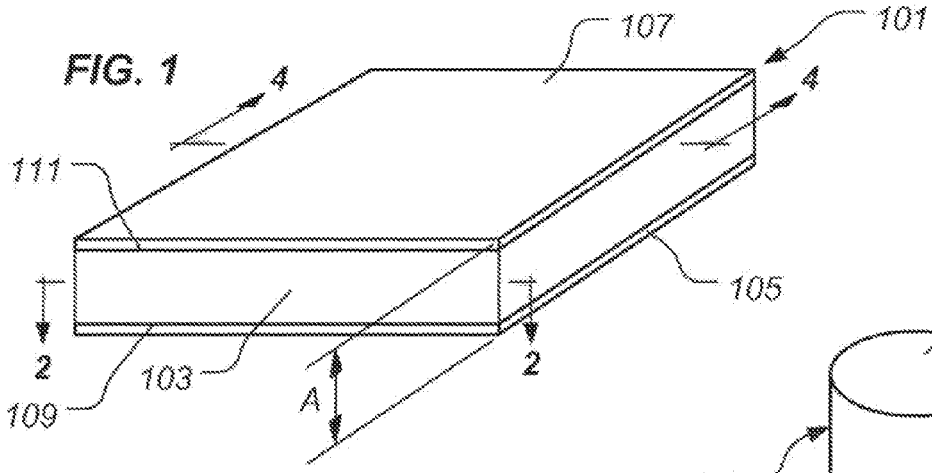
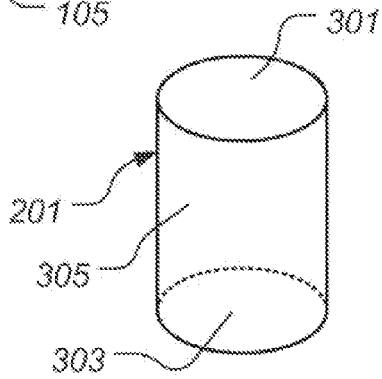
FIG. 3
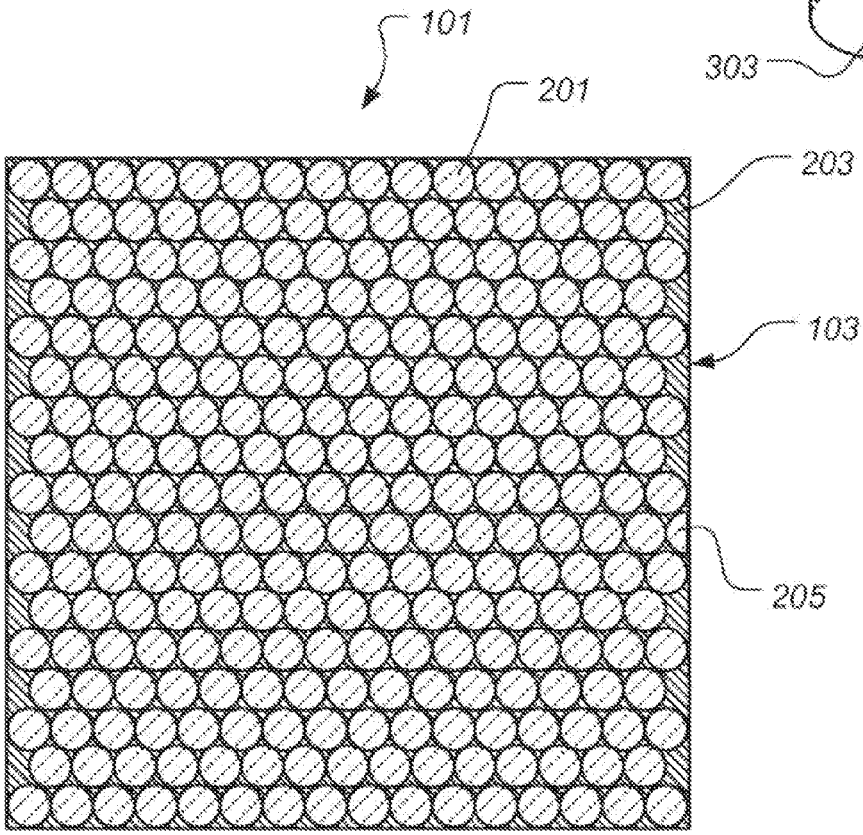
FIG. 2

ARMOR AND METHOD OF MAKING SAME

CROSS-REFERENCE TO RELATED APPLICATIONS

This application is a continuation-in-part of commonly-owned, co-pending U.S. patent application Ser. No. 11/365,235, Entitled "Armor and Method of Making Same" by inventor David L. Hunn, filed on 1 Mar. 2006, which is a continuation-in-part of commonly-owned, co-pending U.S. patent application Ser. No. 11/347,526, entitled "Armor and Method of Making Same" by inventor David L. Hunn, filed on 3 Feb. 2006, both of which are incorporated herein by referenced for all purposes.

BACKGROUND

1. Field of the Invention

The present invention relates to armor.

2. Description of Related Art

In combat situations, such as in military, police, and/or armored transport operations, it is desirable to protect vehicles, such as tanks, personnel carriers, trucks, and the like, as well as the vehicle's contents from damage by enemy fire. Accordingly, such vehicles are known to have armor to reduce the likelihood that ballistic rounds or other such projectiles will penetrate the vehicle. If the rounds penetrate the vehicle, the occupants of the vehicle may be injured or the vehicle's ability to operate may be impaired. It may also be desirable for the armor to be able to survive multiple rounds striking the armor in close proximity to one another, so that the integrity of the vehicle is not compromised or is only minimally compromised. Moreover, it is generally desirable for armor to include a relatively hard outer layer that the round encounters first. The hard outer layer starts the projectile or round defeat sequence by increasing the projectile dwell time on the armor, thus slowing the projectile down, or by blunting or fracturing the projectile early in the penetration event.

While protecting the vehicle and its occupants is generally of primary importance, other factors may play a role in the design of armor for the vehicle. It is desirable for the vehicle to be as lightweight as possible. Generally, a vehicle's fuel consumption increases as the vehicle's weight increases. A heavier vehicle usually requires a heavier drive train than a lighter vehicle, which further increases weight. Increased weight may also reduce the mobility of the vehicle and, thus, reduce the utility of the vehicle in combat. As the weight of the vehicle's armor contributes to the overall weight of the vehicle, it is desirable for the vehicle's armor to be as lightweight as possible. Many known armor systems, while protecting the vehicle from ballistic damage, add significant weight to the vehicle and provide little or no additional structural strength to the vehicle.

It is also not desirable for the vehicle's armor to greatly increase the overall size of the vehicle (e.g., the vehicle's height, width, length, volume, and the like), so that existing transportation equipment (e.g., trucks, trailers, aircraft, and the like) are capable of transporting the vehicle. If the size of the vehicle is increased over previous vehicles, the existing transportation equipment may not be capable of transporting the vehicle, or the existing transportation equipment may be limited to carrying fewer vehicles per load. Additionally, it is desirable to maximize the internal volume of the vehicle to allow adequate space to house the crew and crew gear. Accordingly, armor having lower volumes generally result in vehicle designs having larger internal volumes. The overall size of the vehicle is also a factor in combat situations. Generally, smaller targets (i.e., smaller vehicles) are more difficult to hit with artillery, such as rockets, mortars, missiles, and the like. Thus, it is desirable for the vehicle's overall size to be smaller, rather than larger, to reduce the likelihood of an artillery hit.

It is also desirable that the vehicle's armor be durable. During combat and during travel between combat locations, the vehicle may encounter flying rocks, debris, shrapnel, and the like. If the armor is overly thin or brittle, it may not be capable of surviving impacts from such sources.

Cost is also a consideration in vehicle armor. Armor that uses exotic materials (e.g., laminated ceramics of boron carbide, silicon carbide, alumina, and the like), or armor that has many components in difficult-to-produce configurations, may be quite effective in combat but may be unaffordable.

There are many designs of materials that are useful as armors and that are well known in the art; however, considerable shortcomings remain.

SUMMARY OF THE INVENTION

In one aspect, an armor is provided that includes a metallic matrix; a plurality of ceramic rods disposed in the metallic matrix, the plurality of ceramic rods and the metallic matrix forming a core; and a spall liner disposed adjacent a rear face of the core. The metallic matrix places a compressive stress on the plurality of ceramic rods.

In another aspect of the present invention, an armor is provided. The armor includes a face sheet, a spall liner, and a core disposed between the face sheet and the spall liner. The core comprises a cast metallic matrix and a plurality of ceramic rods disposed in the cast metallic matrix, such that the metallic matrix places a compressive stress on the plurality of ceramic rods.

In yet another aspect, the present invention provides a method for making an armor. The method includes the steps of providing a plurality of ceramic rods in a desired configuration and embedding the plurality of ceramic rods in a metallic matrix to form a core, such that the metallic matrix provides a compressive stress to the plurality of ceramic rods. The method further includes providing a spall liner and disposing the spall liner adjacent a rear surface of the core to form an armor.

The present invention provides significant advantages, including: (1) providing an armor capable of withstanding multiple strikes from ballistic projectiles in a small area; (2) providing an armor that has a lower areal weight than conventional armors; and (3) providing an armor that is less expensive to produce than conventional armors.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

FIG. 1 is a stylized, perspective view of an illustrative implementation of an armor;

FIG. 2 is a cross-sectional view of the armor of FIG. 1, taken along the line 2-2 of FIG. 1, depicting a first illustrative embodiment thereof;

FIG. 3 is a perspective view of an illustrative embodiment of a ceramic rod used in the armor of FIG. 1;

Figure 4:
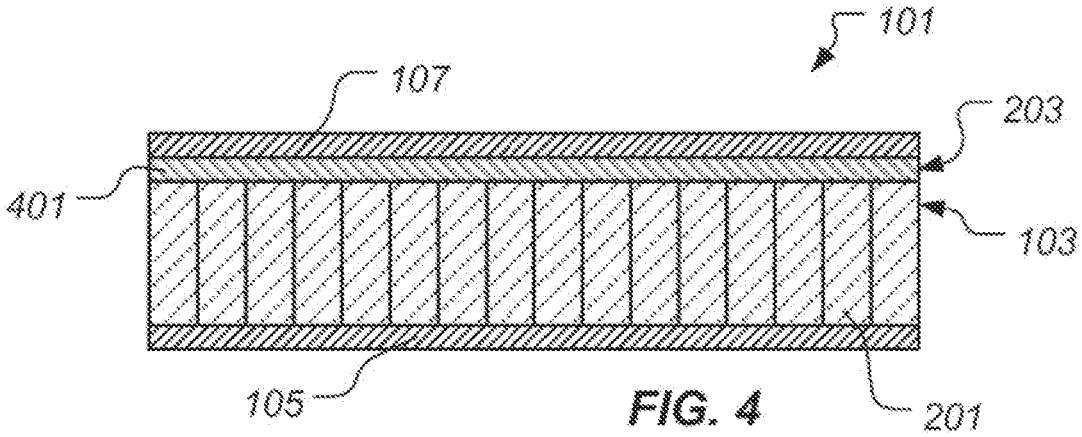
FIG. 4 is a cross-sectional view of the armor of FIG. 1, taken along the line 4-4 of FIG. 1, depicting a first particular core arrangement thereof.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

It should be appreciated that the following terms and phrases are intended to have a particular meaning throughout the following detailed description. The term "ceramic" refers to an inorganic, non-metallic material whose formation is due to the action of heat. The term "rod" means a three-dimensional, solid cylinder. The term "cylinder" refers to a solid having a surface created by projecting a closed two-dimensional curve along an axis that is not on or parallel to the plane of the curve. In a circular cylinder, the curve is a circle. In a right circular cylinder, the curve is a circle and the plane of the circle is substantially perpendicular to the axis along which the circle is projected. In an octagonal cylinder, the curve is a octagon. In a right, octagonal cylinder, the curve is a octagon and the plane of the octagon is substantially perpendicular to is substantially perpendicular to the axis along which the octagon is projected.

Moreover, "vehicles" are devices, apparatuses, or the like that travel through a medium, such as air or water. Examples of vehicles include, but are not limited to, missiles, rockets, torpedoes, airplanes, helicopters, automobiles, trucks, military tanks, and drones. "Spall" refers to fragments broken from either a barrier (e.g., fragments broken from an armor as the result of penetration or the impact of a projectile) or from a projectile that has impacted the barrier. The term "simple contour," as it relates to surfaces or shapes, is a planar surface that has been curved or bent about an axis. The term "complex contour" as it relates to surfaces or shapes, is a surface or shape that includes no straight lines. The term "gradient" means rising or falling by regular degrees of inclination. The term "hexagonal-close-packed" means an arrangement wherein a central element is surrounded by six adjacent elements, such that the arrangement occupies a minimum amount of space. The term "solidus temperature" means a temperature below which a given substance is stable in the solid phase. The term "casting" means a process by which a material is introduced into a mold or crucible while the material is liquid, wherein the material is allowed to solidify in the shape inside the mold and is then removed producing a fabricated object, part, or casting. The term "draft," as it pertains to this disclosure, means a taper that a part exhibits to allow the part to be removed from another part.

The present invention represents an armor for lessening the destructive effects of ballistic projectiles, such as bullets. Generally, the armor comprises a core including plurality of ceramic rods disposed in a metallic matrix that provides a compressive stress to the plurality of ceramic rods. A spall liner is disposed adjacent a back surface of the core. In some embodiments, a face sheet is disposed adjacent a front surface of the core. In use, the armor is oriented such that ballistic projectiles will preferably impact the face sheet, if provided, or the front surface of the core, if the face sheet is omitted.

FIG. 1 depicts a perspective view of one particular implementation of an armor 101. It should be noted, however, that the various embodiments of the armor described herein and shown in the drawings may take on many different forms and implementations. Armor 101 comprises a core 103 disposed between a spall liner 105 and an optional face sheet 107. If face sheet 107 is omitted, spall liner 105 is disposed adjacent a rear surface 109 of core 103, such that a ballistic projectile preferably contacts a front surface 111 of core 103 first. Various embodiments and arrangements of core 103 are illustrated in FIGS. 2 and 4-10.

While armor 101 is illustrated as being substantially planar in shape, the present invention contemplates other shapes, such as shapes having simple or complex contours. Moreover, an armor may be generally rectangular, as illustrated herein, or may define any other desired, suitable shape for the particular implementation of the armor. Furthermore, while armor 101 of FIG. 1 is depicted as having a substantially constant thickness A, the present invention contemplates embodiments wherein the thickness of the armor is not constant. In such embodiments, an armor may exhibit a plurality of discrete thicknesses and/or the armor may exhibit one or more thickness gradients.

Preferably, face sheet 107, if present, comprises a material that will, to some degree, impede the progress of a ballistic projectile. For example, in various embodiments, face sheet 107 comprises titanium; a titanium alloy; aluminum; an aluminum alloy; an organic-matrix composite material, such as, for example, graphite-, carbon-, or fiberglass-reinforced epoxy composite material; a metal-matrix composite material, such as carbon-, silicon carbide-, or boron-reinforced titanium or aluminum composite material; a laminated material, such as titanium/aluminum laminate; or the like. Preferably, face sheet 107 comprises titanium; a titanium alloy; aluminum; an aluminum alloy; an organic-matrix composite material, such as, for example, graphite-, carbon-, or fiberglass-reinforced epoxy composite material; a laminated material, such as titanium/aluminum laminate; or the like.

Preferably spall liner 105 comprises a material that will drastically reduce the velocity of spall (e.g., projectile fragments or fragments of armor 101) exiting armor 101. More preferably, spall liner 105 comprises a material that will substantially prevent the spall from exiting armor 101. For example, in various embodiments, spall liner 105 comprises one of the materials disclosed above of which face sheet 107 is comprised. Preferably, spall liner 105 comprises titanium; a titanium alloy; aluminum; an aluminum alloy; an organic-matrix composite material, such as, for example, graphite-, carbon-, or fiberglass-reinforced epoxy composite material; a laminated material, such as titanium/aluminum laminate; or the like. It should be noted, however, that the particular compositions of face sheet 107 and spall liner 105 are implementation specific. Accordingly, the present invention contemplates faces sheets (e.g., face sheet 107) and spall liners (e.g. spall liner 105) comprising any material suitable for a particular implementation.

Referring now to FIG. 2, a first illustrative embodiment of core 103 is depicted. In the illustrated embodiment, core 103 comprises a plurality of ceramic rods 201 (only one indicated for clarity) disposed in a metallic matrix 203. Exemplary materials for metallic matrix 203 include, but are not limited to, aluminum; magnesium; titanium; alloys comprising aluminum, magnesium, or titanium; and steel. Irrespective of the material, metallic matrix 203 places a compressive stress on the plurality of ceramic rods 201, as is discussed in greater detail herein. In other embodiments, metallic matrix 203 (as well as other metallic matrices described herein and shown in the drawings) may be replaced with a polymeric matrix, as described in U.S. patent application Ser. No. 11/347,526 entitled "Armor and Method of Making Same" by inventor David L. Hunn, filed on 3 Feb. 2006.

FIG. 3 illustrates one of the plurality of ceramic rods 201. In this embodiment, each of the plurality of ceramic rods 201 is right circular cylindrical in shape, comprising a first end surface 301, a second end surface 303, and a side wall 305 extending therebetween. The scope of the present invention, however, is not so limited, as will be more fully discussed below. Ceramic rods 201 may comprise various ceramic materials, even within the same armor 101. Such ceramic materials include, but are not limited to aluminum oxide, silicon carbide, boron carbide, or the like. Preferably, ceramic rods 201 comprise aluminum oxide because ceramic rods 201 comprising aluminum oxide generally have a lower cost than ceramic rods 201 comprising other ceramic materials.

Referring again to FIG. 2, ceramic rods 201 are preferably arranged in a hexagonal-close-packed configuration to obtain maximum ceramic rod density of core 103. In such an embodiment, adjacent ceramic rods 201 abut one another and metallic matrix 203 substantially fills interstices between adjacent ceramic rods 201. In one embodiment, one or more partial, cylindrical, ceramic rods 205 may be included in core 103 to further enhance the ceramic rod areal density of core 103.

Figure 5:
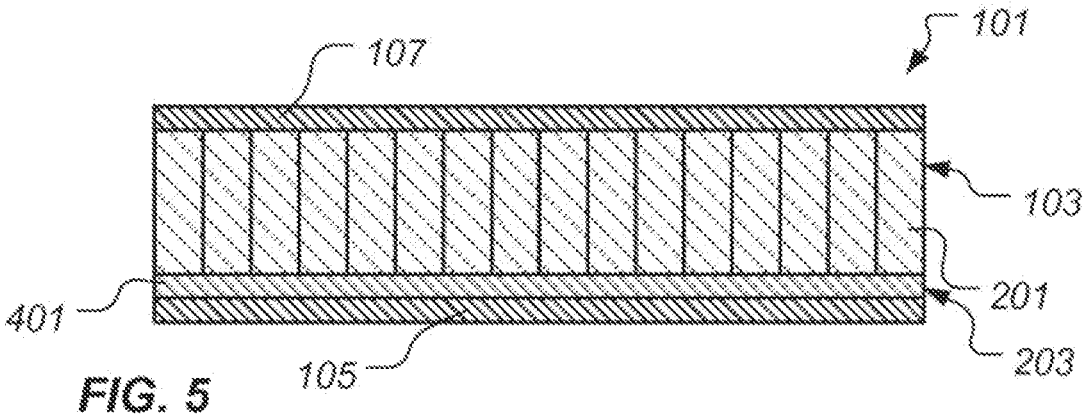
FIG. 5 is a cross-sectional view of the armor of FIG. 1, corresponding to the view of FIG. 4, depicting a second particular core arrangement thereof.
Figure 6:
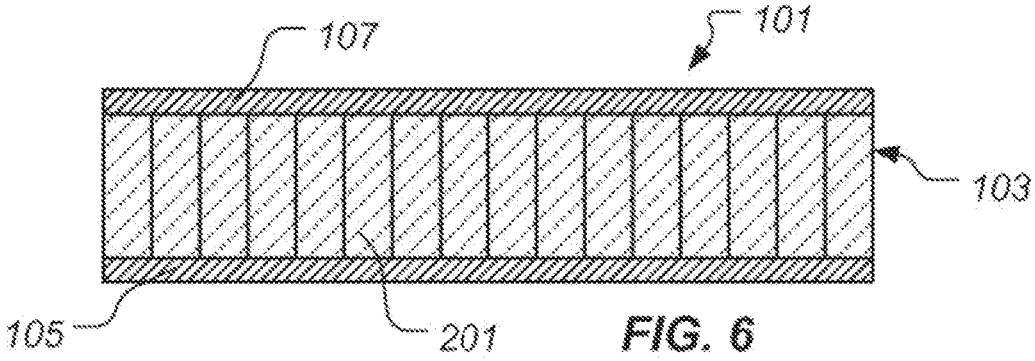
FIG. 6 is a cross-sectional view of the armor of FIG. 1, corresponding to the view of FIG. 4, depicting a third particular core arrangement thereof.

FIGS. 4-6 depict various, illustrative arrangements of core 103. In the particular configuration illustrated in FIG. 4, which includes face sheet 107, a layer 401 of metallic matrix 203 is disposed between ceramic rods 201 and face sheet 107. At least one of the plurality of ceramic rods 201 abuts spall liner 105. Alternatively, as shown in FIG. 5, layer 401 of metallic matrix 203 is disposed between ceramic rods 201 and spall liner 105. In such an embodiment, one or more of the ceramic rods 201 are exposed from metallic matrix 203 and abut face sheet 107, if present. In other words, an end 301 or 303 of ceramic rod 201 may be seen when viewing metallic matrix 203. In another illustrative embodiment, one or more of ceramic rods 201 may directly abut spall liner 105 and face sheet 107, omitting substantially any metallic matrix 203 therebetween, as shown in FIG. 6. Such a configuration is produced when metallic matrix 203 is disposed about side walls 305 (see FIG. 3) of ceramic rods 201, but first end 301 and second end 303 of at least one ceramic rod 201 are exposed from metallic matrix 203. It should be noted that metallic matrix 203 may or may not extend between at least one of the plurality ceramic rods 201 and face sheet 107 and/or spall liner 105.

Figure 7:
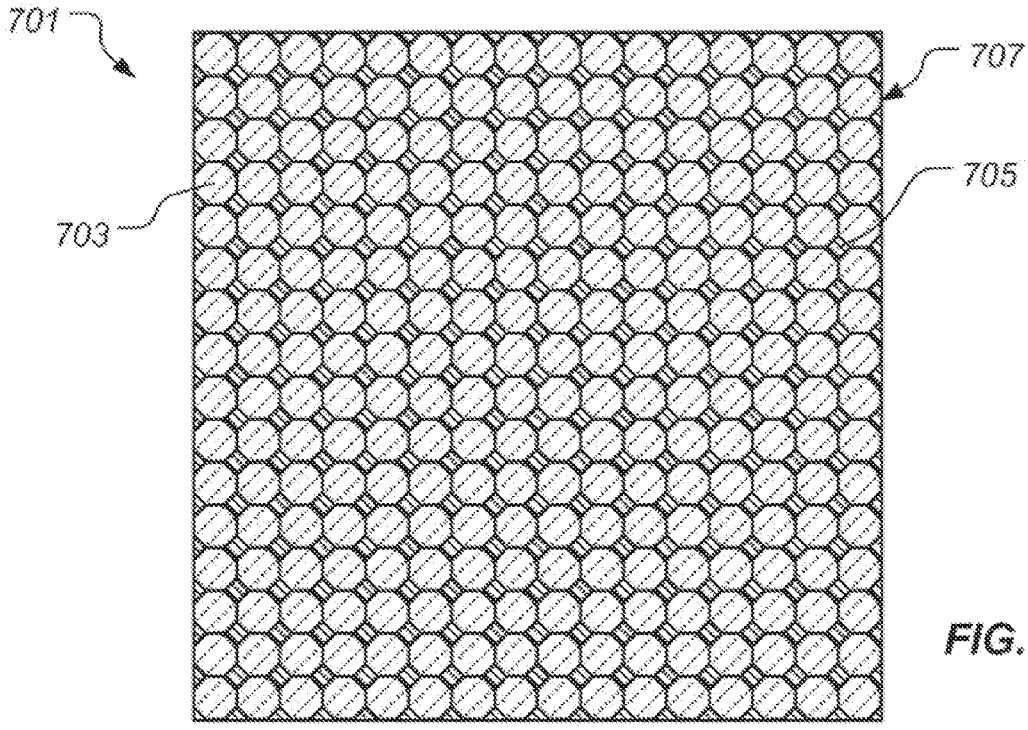
FIG. 7 is a cross-sectional view of a second illustrative embodiment of an armor, corresponding to the view shown in FIG. 2.
Figure 8:
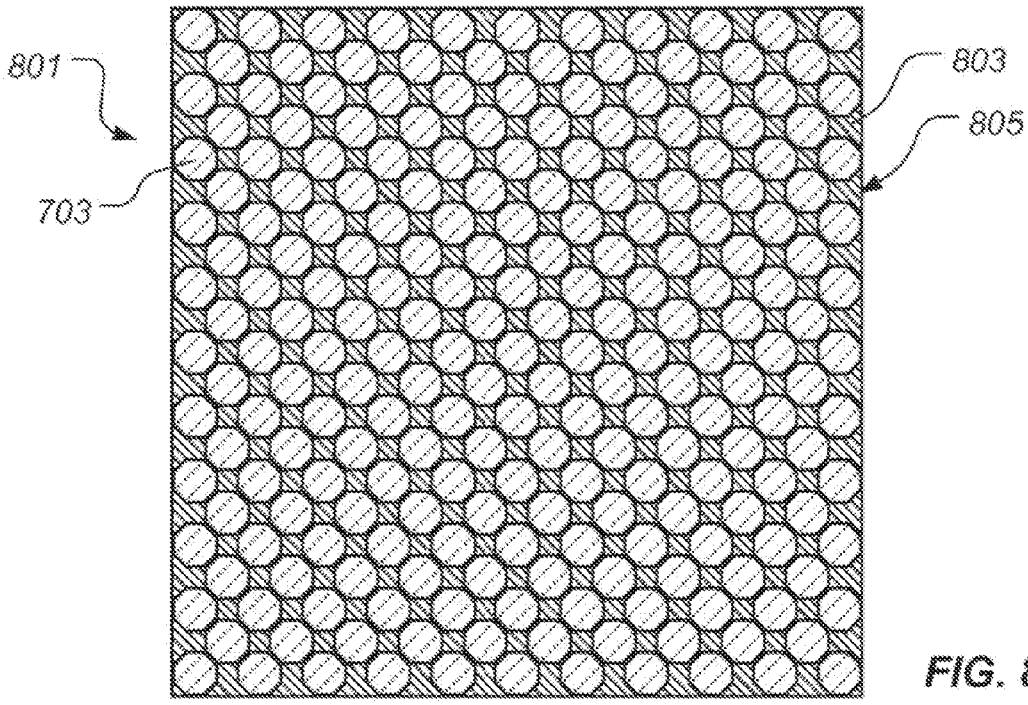
FIG. 8 is a cross-sectional view of a third illustrative embodiment of an armor, corresponding to the view shown in FIG. 2.

While, in a preferred embodiment, ceramic rods 201 are right circular cylindrical in shape, the scope of the present invention is not so limited. Rather, as depicted in FIGS. 7-10, ceramic rods of the present armor may exhibit other shapes. For example, as shown in FIGS. 7 and 8, illustrative embodiments of armors 701 and 801 comprise a plurality of ceramic rods 703 (only one indicated for clarity), having right, octagonal cylindrical shapes. It should be noted that the views depicted in FIGS. 7 and 8 correspond to the view shown in FIG. 2. In the illustrative embodiment of FIG. 7, ceramic rods 703 are arranged to have a greater areal density than in the illustrative embodiment of FIG. 8. In the embodiment of FIG. 7, the plurality of ceramic rods 703 are disposed in a metallic matrix 705, thus forming a core 707, as discussed above concerning the embodiment of FIGS. 2 and 4. In the embodiment of FIG. 8, the plurality of ceramic rods 703 are disposed in a metallic matrix 803, forming a core 805 corresponding to core 103 of FIGS. 2 and 4-6. Other aspects of the embodiments illustrated in FIGS. 7 and 8 generally correspond to the aspects of the embodiments of FIGS. 2 and 4-6.

Figure 9:
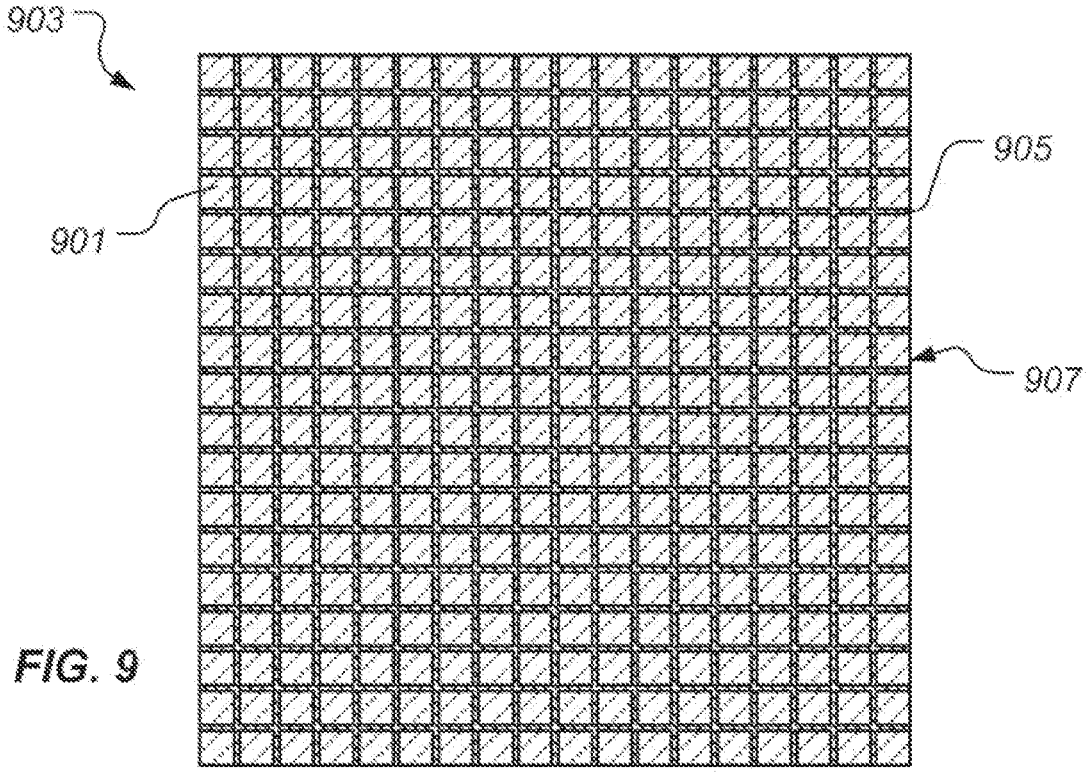
FIG. 9 is a cross-sectional view of a fourth illustrative embodiment of an armor, corresponding to the view shown in FIG. 2.
Figure 10:
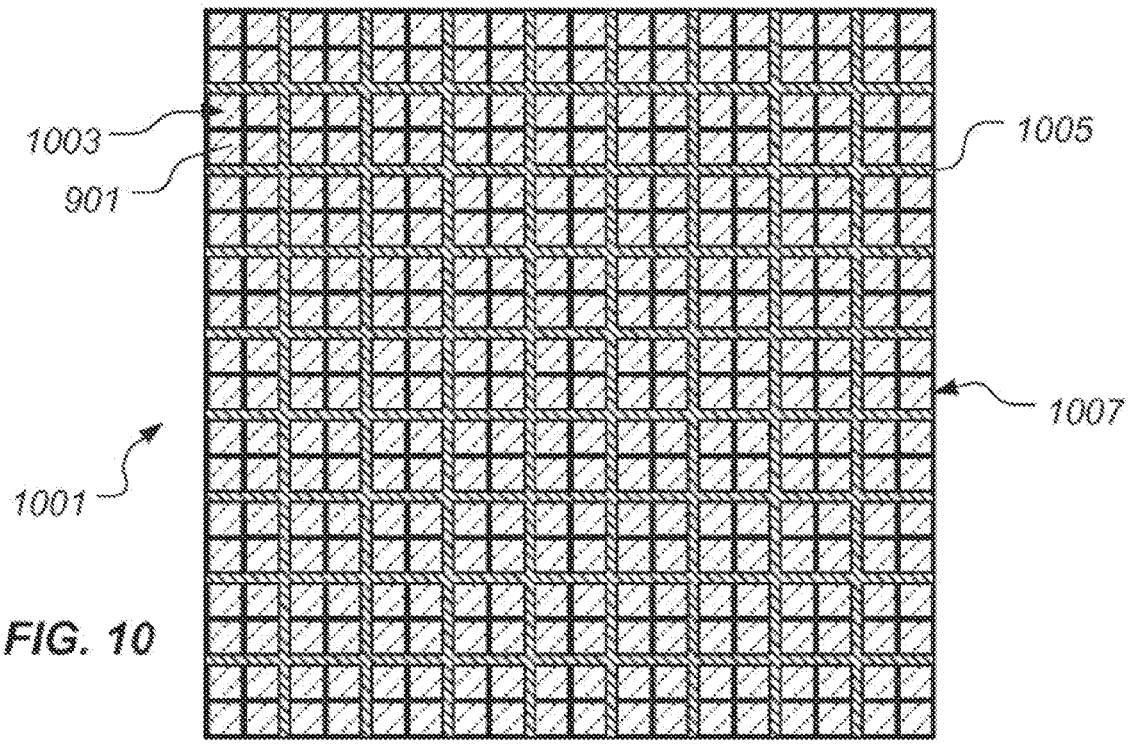
FIG. 10 is a cross-sectional view of a fifth illustrative embodiment of an armor according to the present invention, corresponding to the view shown in FIG. 2.

Alternatively, as illustrated in FIGS. 9 and 10, ceramic rods 901 (only one indicated for clarity) of armor 903 and 1001 may exhibit right, rectangular cylindrical shapes. It should be noted that the views depicted in FIGS. 9 and 10 also correspond to the view shown in FIG. 2. In the particular embodiment of FIG. 9, a metallic matrix 905 is disposed about each ceramic rod 901 to form a core 907. In the embodiment of FIG. 10, some adjacent ceramic rods 901 abut one another to form a group 1003 (only one indicated for clarity) of ceramic rods 901. A metallic matrix 1005 is disposed around each group 1003 of ceramic rods 901 to form a core 1007. It will be appreciated, however, that other configurations are possible and those configurations are contemplated by the present invention. For example, in the embodiment illustrated in FIG. 10, a group 1003 of ceramic rods 901 comprises four ceramic rods 901. Other embodiments of armor, however, may include groups of two or more ceramic rods (e.g., ceramic rods 901).

Figure 19:
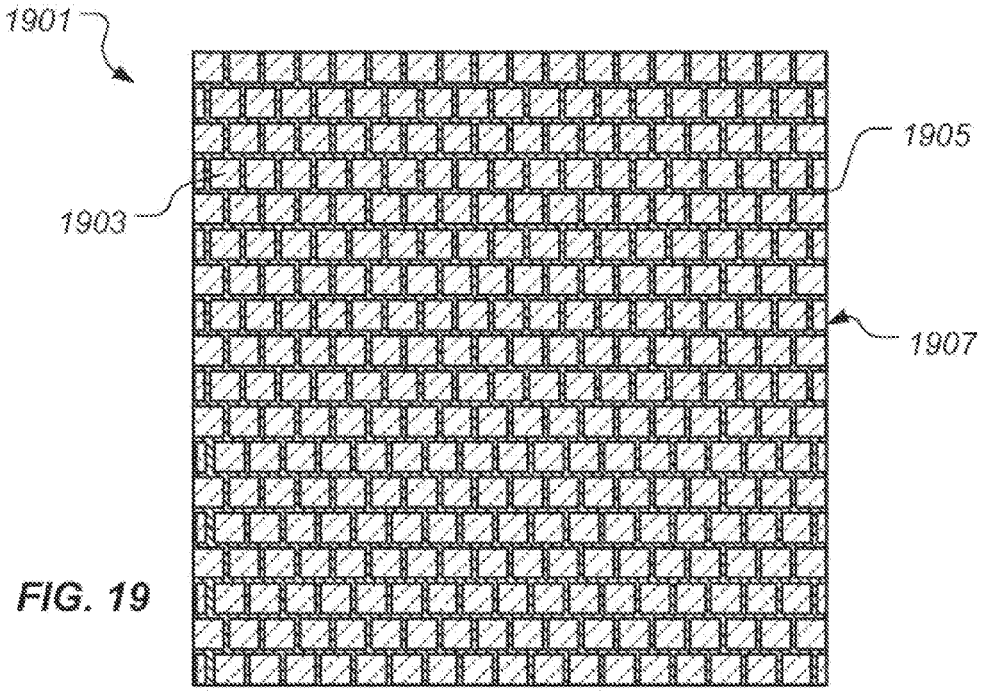
FIG. 19 is a cross-sectional view of an illustrative embodiment of an armor alternative to that of FIG. 9, corresponding to the view shown in FIG. 2.

Alternatively, as shown in FIG. 19, an armor 1901 comprises a plurality of right rectangular cylindrical ceramic rods 1903 disposed in a metallic matrix 1905 to form a core 1907. As compared to the embodiment of FIG. 9, ceramic rods 1903 are offset from one another, such that metallic matrix 1905 extends therebetween.

It should be noted that the particular configurations of armor that are disclosed herein and illustrated in the drawings are merely exemplary. The particular configuration of the armor is implementation specific and, therefore, may take on many different forms. For example, particular elements of the armor, as well as the armor itself, may exhibit different size and/or geometrical relationships than those illustrated herein. In such embodiments, for example, right cylindrical, ceramic rods 201, 703, and/or 901 may be merely cylindrical in shape. Thus, for example in embodiments wherein the armor exhibits a thickness gradient, ceramic rods 201 (best shown in FIG. 3) may be replaced with ceramic rods having one or more ends that are not substantially perpendicular to a side wall thereof.

The armor, however, comprises a core disposed between an optional face sheet and a spall liner. The core comprises a plurality of ceramic rods disposed in a metallic matrix. In embodiments wherein the face sheet is omitted, the core is disposed adjacent the spall liner. The face sheet (if present), core, and spall liner may be held in assembly by any suitable means, such as, for example, mechanical fastening means, adhesives, or the like.

It should be noted that the armor (e.g., armor 101, 701, 801, 903, 1001, or the like) may comprise a portion of or be attached to a vehicle, such as, for example, a tank, a personnel carrier, a truck, or the like. In one particular operation of the present armor, a ballistic projectile striking face sheet 107 is somewhat blunted and the shock associated with the ballistic projectile striking face sheet 107 is dissipated or attenuated to a degree by metallic matrix 203. In many instances, the ballistic projectile passes through face sheet 107, striking core 103, 707, 805, 907, or 1007. Upon striking one or more ceramic rods 201, 703, or 901, the ballistic projectile is further blunted or fragmented. The one or more ceramic rods 201, 703, or 901 are likely also fragmented or shattered; however, metallic matrix 203, 705, 803, 905, or 1005 aids in decreasing the velocity of ballistic projectile fragments and ceramic rod fragments, which are retained in armor 101, 701, 801, 903, or 1001 by spall liner 105. In some situations, metallic matrix 203, 705, 803, 905, or 1005 also aids in dissipating the impact of the ballistic projectile and/or fragments thereof. It should be noted that the armor is capable of withstanding multiple ballistic projectile strikes in a local area.

Figure 11:
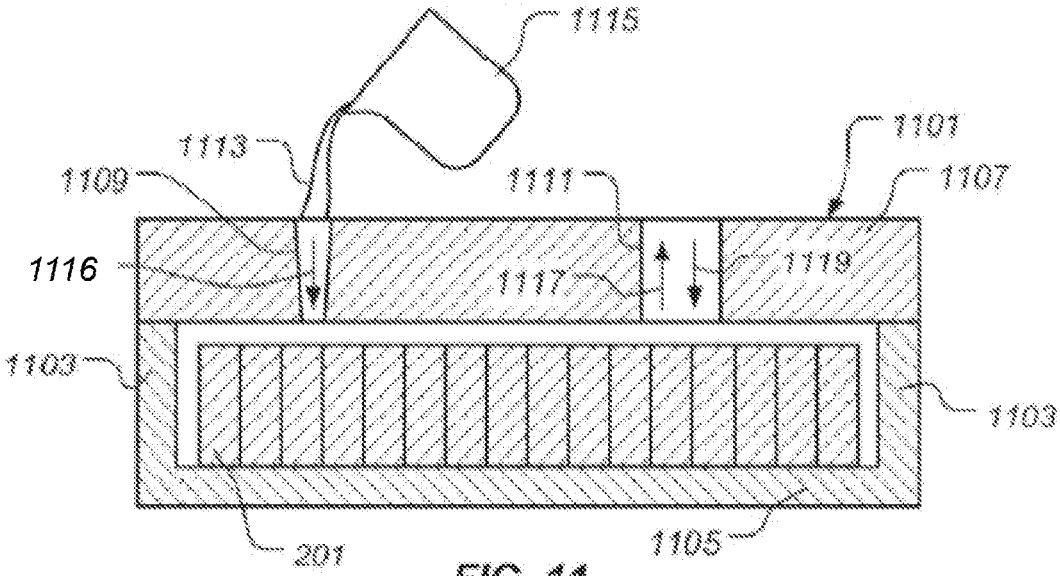
FIGS. 11-13 are stylized, cross-sectional views, corresponding to the view of FIG. 4, depicting a first illustrative method for making a core of the armor disclosed herein.
Figure 12:
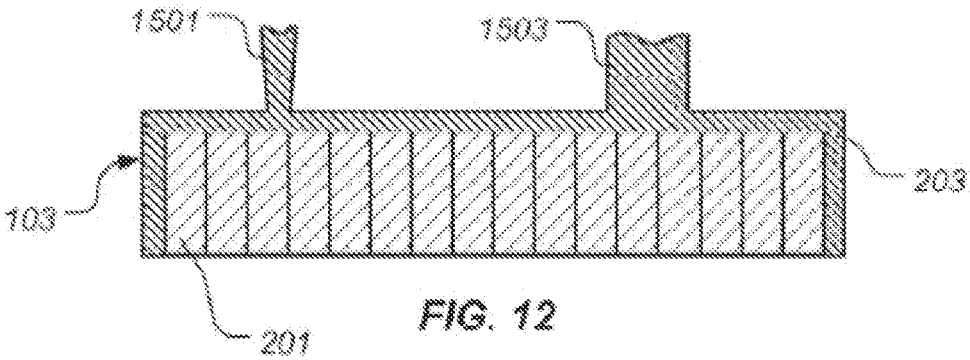
Figure 13:
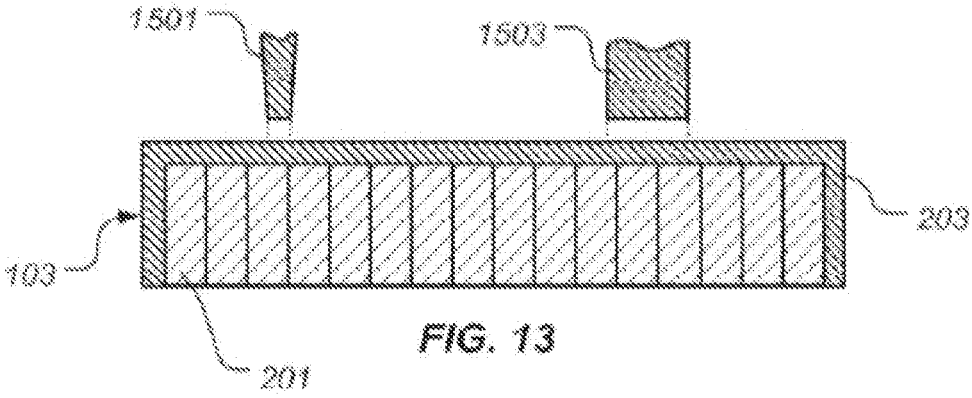

FIGS. 11-13 depict a first illustrative embodiment of a method for making the core, such as core 103, 707, 805, 907, 1007, or the like, of an armor, such as armor 101,701, 801, 903, 1001, or the like. It should be noted that the views shown in FIGS. 11-13 are cross-sectional views corresponding to the views of FIGS. 4-6. It should also be noted that, while the method is described below in relation to armor 101, the scope of the present invention is not so limited. Rather, the method may be used to make any of the armor embodiments disclosed herein and their equivalents.

Referring to FIG. 11, the plurality of ceramic rods 201 (only one labeled for clarity) are placed into a flask, mold, or crucible 1101 having side walls 1103, a bottom 1105, and a top 1107. Preferably, side walls 1103 exhibit a draft, which aids in removal of core 103 from crucible 1101. Top 1107 defines a sprue 1109 and a riser 1111. Molten metal 1113 is poured from a ladle 1115 or other such container through sprue 1109, as indicated by an arrow 1116, into crucible 1101, such that molten metal 1113 flows about the plurality of ceramic rods 201. As crucible 1101 becomes filled with molten metal 1113, molten metal 1113 flows into riser 1111, as indicated by an arrow 1117. Once molten metal 1113 has risen to a sufficient level in riser 1111, pouring of molten metal 1113 from ladle 1115 is halted. As molten metal 1113 cools in crucible 1101, molten metal 1113 disposed in riser 1111 flows back into crucible 1101, as indicated by an arrow 1119, to ensure the volume within crucible 1101 remains filled and to inhibit porosity in metallic matrix 203, which molten metal 1113 becomes when solidified. Accordingly, metallic matrix 203 places a compressive stress on the plurality of ceramic rods 201. FIG. 11 depicts the making of the embodiment of core 103 shown in FIG. 4 or 5, although the present invention is not so limited. FIG. 12 depicts core 103 with a sprue casting 1501 and a riser casting 1503 still attached. Sprue casting 1501 and riser casting 1503 are removed, as shown in FIG. 13, to form a completed core 103.

Figure 14:
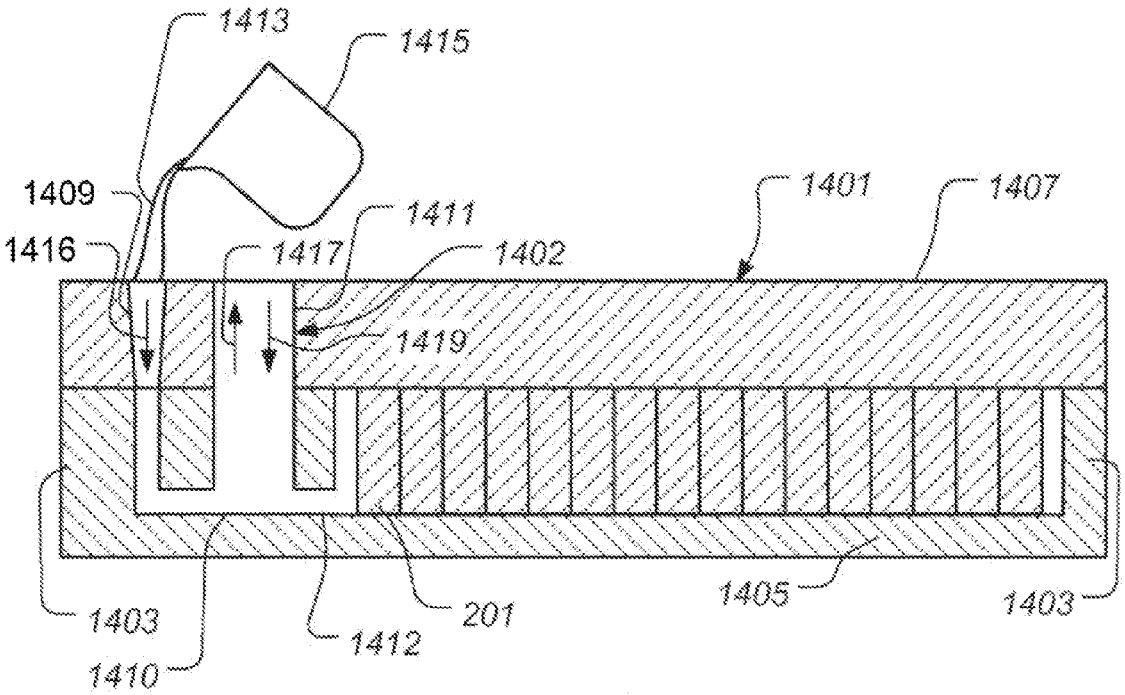
FIGS. 14 and 15 are stylized, cross-sectional views, corresponding to the view of FIG. 6, depicting a second illustrative method for making a core of the armor disclosed herein.
Figure 15:
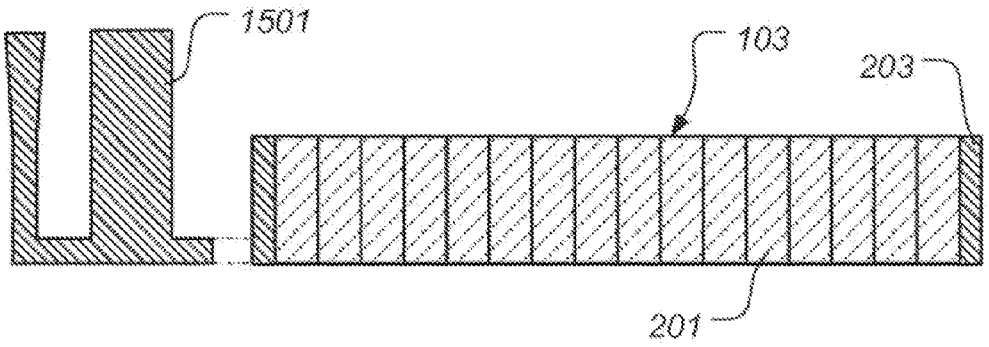

FIGS. 14 and 15 depict a second illustrative embodiment of a method for making the core, such as core 103, 707, 805, 907, 1007, or the like, of an armor, such as armor 101, 701, 805, 903, 1001, or the like. It should be noted that the views shown in FIGS. 14 and 15 are cross-sectional views corresponding to the views of FIGS. 4-6. It should also be noted that, while the method is described below in relation to armor 101, the scope of the present invention is not so limited. Rather, the method may be used to make any of the armor embodiments disclosed herein and their equivalents.

Referring to FIG. 14, the plurality of ceramic rods 201 (only one labeled for clarity) are placed into a flask, mold, or crucible 1401 having side walls 1403, a bottom 1405, and a top 1407. Preferably, side walls 1403 exhibit a draft, which aids in removal of core 103 from crucible 1401. Crucible 1401 defines gating system 1402, including, for example, a sprue 1409, a runner 1410, and a gate 1412, as well as a riser 1411. Molten metal 1413 is poured from a ladle 1415 or other such container through sprue 1409, runner 1410, and gate 1412, as indicated by an arrow 1416, into crucible 1401 such that molten metal 1413 flows about the plurality of ceramic rods 201. As crucible 1401 becomes filled with molten metal 1413, molten metal 1413 flows into riser 1411, as indicated by an arrow 1417. Once molten metal 1413 has risen to a sufficient level in riser 1411, pouring of molten metal 1413 from ladle 1415 is halted. As molten metal 1413 cools in crucible 1401, molten metal 1413 disposed in riser 1411 flows back into crucible 1401, as indicated by an arrow 1419, to ensure the volume within crucible 1401 remains filled and to inhibit porosity in metallic matrix 203, which molten metal 1413 becomes when solidified. Accordingly, metallic matrix 203 places a compressive stress on the plurality of ceramic rods 201. FIG. 14 depicts the making of the embodiment of core 103 shown in FIG. 6, although the present invention is not so limited. A gating system casting 1501 are removed from core 103, as shown in FIG. 15, to form a completed core 103.

Figure 16:
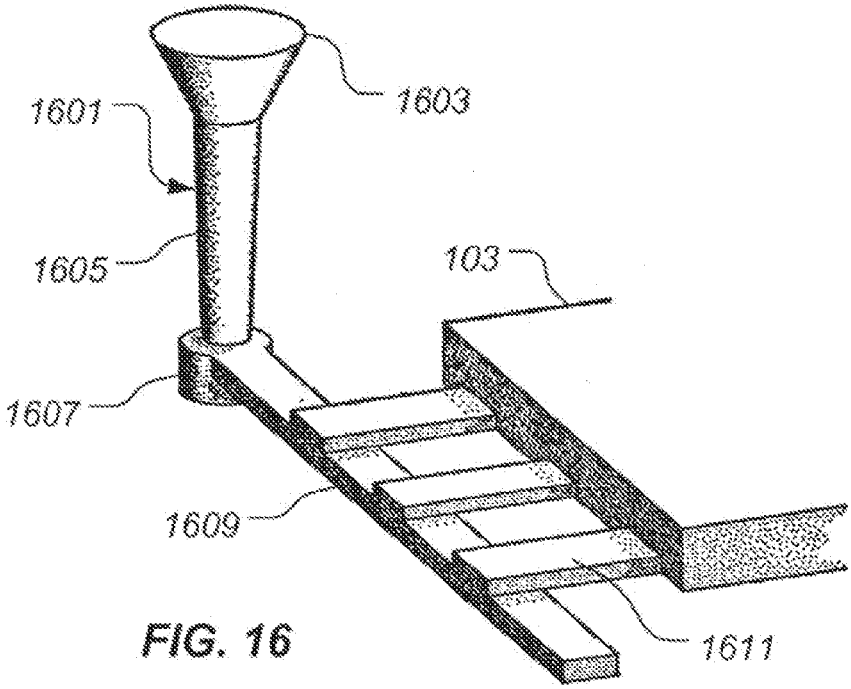
FIG. 16 is a stylized, perspective view of an exemplary gating system.

It should be noted that the particular configurations of crucible 1101 and 1401 depicted in FIGS. 11 and 14, respectively, are merely exemplary of the configurations contemplated by the present invention. The particular configuration employed is implementation specific. Any suitable configuration is encompassed within the scope of the present invention. For example, as shown in FIG. 16, a gating system 1601 employed to direct molten metal in a crucible may include many different components of varying configuration, such as a pouring cup 1603, a sprue 1605, a sprue well 1607, one or more runners 1609, and one or more gates 1611 (only one labeled for clarity). Pouring cup 1603, sprue 1605, sprue well 1607, the one or more runners 1609, and the one or more gates 1611 are in fluid communication with one another and in fluid communication with a cavity of the crucible in which core 103 or the like is formed. It should be noted that gating system 1601 is shown in FIG. 16 as positive elements, i.e., the resulting casting attached to core 103, rather than negative elements for clarity.

Figure 17:
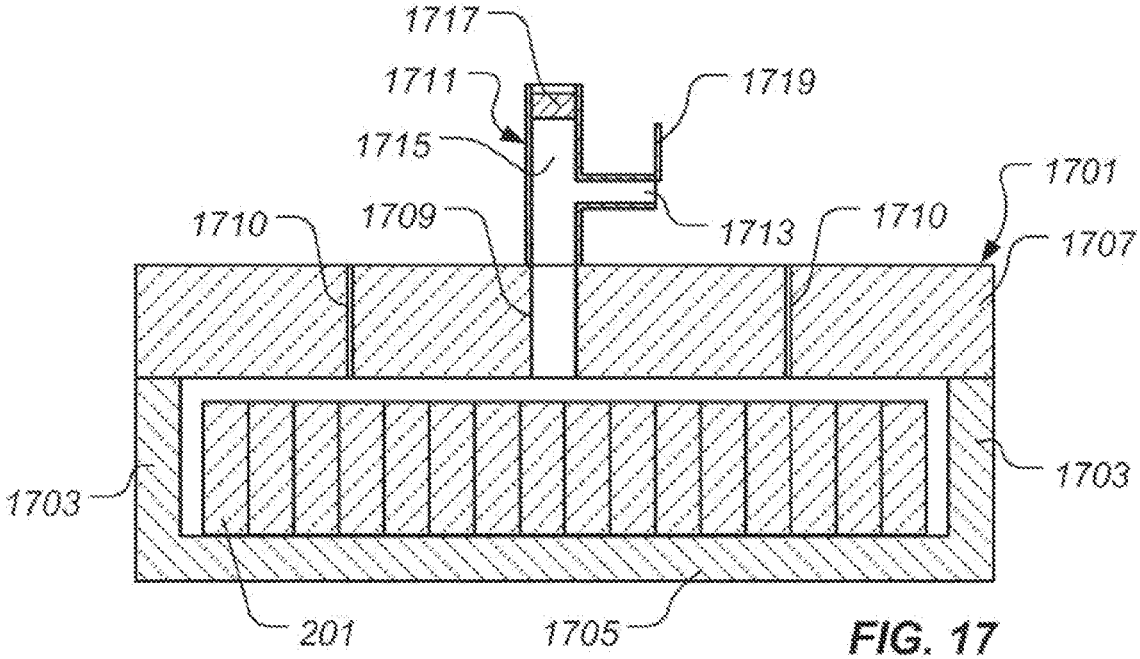
FIGS. 17 and 18 are stylized, cross-sectional views, corresponding to the view of FIG. 4, depicting a third illustrative method for making a core of the armor disclosed herein.
Figure 18:
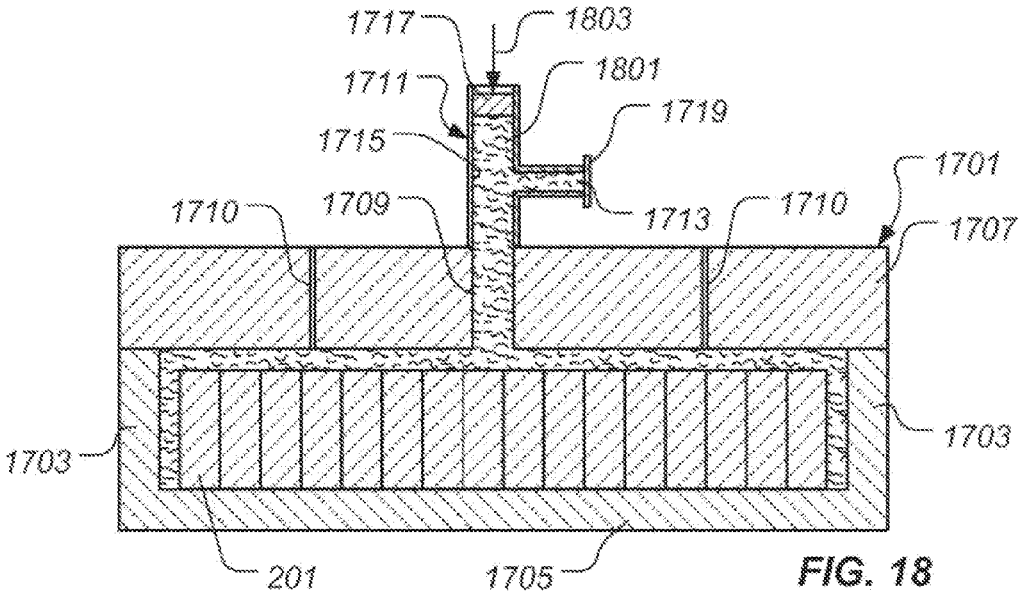

FIGS. 17 and 18 depict a third illustrative embodiment of a method for making the core, such as core 103, 707, 805, 907, 1007, or the like, of an armor, such as armor 101, 701, 903, 1001, or the like. It should be noted that the views shown in FIGS. 11-13 are cross-sectional views corresponding to the views of FIGS. 4-6. It should also be noted that, while the method is described below in relation to armor 101, the scope of the present invention is not so limited. Rather, the method may be used to make any of the armor embodiments disclosed herein and their equivalents.

Referring to FIG. 17, the plurality of ceramic rods 201 (only one labeled for clarity) are placed into a flask, mold, or crucible 1701 having side walls 1703, a bottom 1705, and a top 1707. Preferably, side walls 1703 exhibit a draft, which aids in removal of core 103 from crucible 1701. Top 1707 defines a sprue 1709 and one or more vents 1710. An injection fitting 1711 is placed in fluid communication with sprue 1709. Injection fitting 1711 defines a port 1713 and a cavity 1715. Injection fitting comprises a piston 1717 for urging molten metal into crucible 1701 and a gate 1719 for closing port 1713. It should be noted that FIG. 17 depicts a stylized representation of crucible 1701 and injection fitting 1711. The scope of the present invention encompasses many different variations of crucible 1701 and injection fitting 1711.

Turning now to FIG. 18, molten metal 1801 is injected through port 1713 and cavity 1715 into crucible 1701. Gases, such as air, present in crucible 1701 are ported therefrom via one or more vents, such as vents 1710. When molten metal 1801 has filled crucible 1701, including sprue 1709, molten metal 1801 rises into cavity 1715. Gate 1719 is closed, as shown in FIG. 18, and piston 1717 is urged as shown by an arrow 1803 to pressurize molten metal 1801 in crucible 1701. As molten metal 1801 cools in crucible 1701, molten metal 1801 disposed in cavity 1715 is urged into crucible 1701 by piston 1717 to ensure the volume within crucible 1701 remains filled and to inhibit porosity in metallic matrix 203, which molten metal 1801 becomes when solidified. Accordingly, metallic matrix 203 places a compressive stress on the plurality of ceramic rods 201. FIGS. 17 and 18 depict the making of the embodiment of core 103 shown in FIG. 4 or 5, although the present invention is not so limited.

It should be noted that the present invention contemplates modifying the method depicted in FIG. 14 to use the pressurized casting technique discussed herein and shown in FIGS. 17 and 18. The particular configuration depicted in FIGS. 17 and 18 are merely exemplary of the configurations contemplated by the present invention.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. An armor, comprising:
a metallic matrix;
a plurality of ceramic rods disposed in the metallic matrix in a close-packed configuration, the plurality of ceramic rods and the metallic matrix forming a core;
a spall liner disposed adjacent a rear face of the core; and
a face sheet disposed adjacent a front face of the core, the face sheet comprising a material configured to impede progress of a ballistic projectile;
wherein the metallic matrix places a compressive stress on the plurality of ceramic rods; and
wherein a first surface of each ceramic rod of the plurality of ceramic rods abuts the face sheet and a second surface of each ceramic rod abuts the spall liner.

2. The armor, according to claim 1, wherein the face sheet comprises:
a material selected from the group consisting of titanium, a titanium alloy, aluminum, an aluminum alloy, an organic-matrix composite material, a metal-matrix composite material, a laminated material, and a titanium/aluminum laminate.

3. The armor, according to claim 1, wherein the metallic matrix extends between at least one ceramic rod of the plurality of ceramic rods and the face sheet.

4. The armor, according to claim 1, wherein the metallic matrix extends between at least one ceramic rod of the plurality of ceramic rods and the spall liner.

5. The armor, according to claim 1, wherein the metallic matrix comprises:
a material selected from the group consisting of aluminum, magnesium, titanium, an alloy including aluminum, an alloy including magnesium, an alloy including titanium, and steel.

6. The armor, according to claim 1, wherein at least one of the plurality of ceramic rods comprises:
a material selected from the group consisting of aluminum oxide, silicon carbide, and boron carbide.

7. The armor, according to claim 1, wherein a thickness of the armor is not constant.

8. The armor, according to claim 1, wherein the spall liner comprises:
a material selected from the group consisting of titanium, a titanium alloy, aluminum, an aluminum alloy, an organic-matrix composite material, a metal-matrix composite material, a laminated material, and a titanium/aluminum laminate.

9. The armor, according to claim 1, wherein the armor is operably associated with a vehicle.

10. The armor, according to claim 1, wherein the armor is configured to form a portion of a vehicle.

11. The armor, according to claim 1, wherein the armor exhibits a curved shape.

12. The armor, according to claim 1, wherein the metallic matrix is formed by a casting process in accordance with a mold and gating system.

13. The armor, according to claim 1, wherein the plurality of ceramic rods comprises octagonal cylinders.

14. The armor, according to claim 1, wherein the plurality of ceramic rods comprises right rectangular cylindrical ceramic rods.

15. The armor, according to claim 14, wherein each ceramic rod is arranged in the armor such that a layer of the metallic matrix covers the ceramic rod on four sides.

16. The armor of claim 1, wherein the plurality of ceramic rods are disposed in the metallic matrix in a hexagonal close-packed configuration.

17. The armor of claim 1, wherein the plurality of ceramic rods are disposed in the metallic matrix in an octagonal close-packed configuration.

18. A method for making the armor according to claim 1, the method comprising:

providing the plurality of ceramic rods;

embedding the plurality of ceramic rods in the metallic matrix to form the core, such that the metallic matrix provides the compressive stress to the plurality of ceramic rods;

disposing the face sheet adjacent the front face of the core such that the first surface on first end of each ceramic rod of the plurality of ceramic rods abuts the face sheet; and disposing the spall liner adjacent a rear face of the core such that the second surface on a second end of each ceramic rod abuts the spall liner.

19. The method, according to claim 18, wherein embedding the plurality of ceramic rods in the metallic matrix comprises a casting process using a mold and gating system.

20. An armor, comprising:

a metallic matrix;

a plurality of ceramic rods disposed in the metallic matrix in a close-packed configuration, the plurality of ceramic rods and the metallic matrix forming a core;

a spall liner disposed adjacent a rear face of the core; and a face sheet disposed adjacent a front face of the core;

wherein the metallic matrix places a compressive stress on the plurality of ceramic rods;

wherein the plurality of ceramic rods comprises right rectangular cylindrical ceramic rods; and wherein the plurality of ceramic rods is arranged in groups of abutting ceramic rods, each group surrounded by the metallic matrix on four sides.

* * * * *